United States Patent [19]

Marzullo

[11] Patent Number: 4,836,132

[45] Date of Patent: Jun. 6, 1989

[54] WICK CARTRIDGE ASSEMBLY

[75] Inventor: Joseph H. Marzullo, Danbury, Conn.

[73] Assignee: Pitney Bowes Inc., Stamford, Conn.

[21] Appl. No.: 222,675

[22] Filed: Jul. 21, 1988

[51] Int. Cl.[4] ..... B05C 1/06

[52] U.S. Cl. ..... 118/264; 118/268

[58] Field of Search ..... 118/209, 264, 268

[56] References Cited

U.S. PATENT DOCUMENTS

| | | | |
|---|---|---|---|
| 2,035,375 | 3/1936 | Phillips | 118/209 |
| 2,095,038 | 10/1937 | Ragot | 118/264 |
| 2,348,067 | 5/1944 | Hoitt | 118/264 |
| 2,362,755 | 11/1944 | Kreuger | 118/209 |
| 2,944,511 | 7/1960 | Bach et al. | 118/209 |
| 4,300,473 | 11/1981 | Poynter | 118/264 |
| 4,380,210 | 4/1983 | Auerbach | 118/264 |

*Primary Examiner*—Willard Hoag

*Attorney, Agent, or Firm*—Lawrence E. Sklar; David E. Pitchenik; Melvin J. Scolnick

[57] ABSTRACT

A wick cartridge assembly including a cage having openings at opposite ends thereof, a water permeable, mesh surface secured to the interior of the cage and defining an enclosure at one of the openings, and a length of moistening, wick material having one end thereof abutting the mesh enclosure. The assembly is especially useful in moistening apparatus employed with buckle chute folders.

15 Claims, 4 Drawing Sheets

WICK CARTRIDGE ASSEMBLY

BACKGROUND OF THE INVENTION

The instant invention relates to a wick cartridge assembly which may be used for wetting document sheets passing thereover, and more particularly to such an assembly for wetting document sheets containing a water-activated adhesive.

Millions of business correspondence forms are utilized in commerce and the like, such as billing invoices, delivery notification, and the like. At the present time, multisheet business forms, some utilizing carbon paper or other means of duplication, are sold by manufacturers and delivered to the users. The forms are removed from their shipping container and inserted in a typewriter or printer which may be operated by a computer. The billing information or the like may be fed into a computer system which operates the typewriter or printer, to place the desired billing information on the forms. Each form may differ in its information, in that the typewriter or printer will insert a different customer with a different address, and a different billing amount (or other information) for each form.

In the above prior art systems, it is necessary for the forms to carry severable, lateral side strips having holes into which the pins of a form feeding sprocket fit, so that there is precise control of the position of the data entered onto the various layers of the business form, which is typically pre-printed. The pre-printed portions must, of course, be in precise registration with the material which is added by the computerized typewriter or printer.

After the desired information has been entered by the computerized typewriter or printer, the forms are manually severed from each other, and the side strips with holes are removed. The forms may then be placed in an envelope.

The amount of paper in the side strips generally constitutes approximately 10 percent of the entire paper used in the forms, and thus constitutes a significant waste of paper, since the side strips are discarded. Furthermore, a considerable amount of manual labor is necessary to remove the forms from the typewriter or printer, to separate the forms and insert them into envelopes. Additionally, a significant amount of waste and delay is encountered by the simple step of shipping the blank business forms to the processor, involving the added expense of packaging materials and shipping expenses.

In response to the foregoing problems, a process has been developed for the production of message-containing envelopes in which the message may differ. Because the lateral, removable, perforated portions for alignment are unnecessary, there is a substantial savings in paper. The end product of this process constitutes a sealed, addressed envelope, ready for mailing. The assignee of the instant invention has developed apparatus for forming such envelopes from flexible sheets containing a water-activated adhesive. More specifically, the assignee of the instant invention has developed apparatus for applying moisture to a flexible document containing a water-activated adhesive. The apparatus includes a reservoir for storing a source of water, a supporting arm extending from the reservoir, a pivotable hammer pivotably mounted to the supporting arm and extending toward the reservoir, and a moistening wick extending from the reservoir toward the pivotable hammer. The area between the moistening wick and the pivotable hammer defines a document path. The apparatus further includes a flexible, one-way gate secured to the lower portion of the hammer for movement therewith, the gate having an end portion extending into the document path. The apparatus also includes a gate deflector secured to the gate and lower hammer portion for movement therewith. Movement of a document up the document path from the gate deflector toward the pivotable hammer causes the gate to flex out of the document path and movement of a document down the document path from the pivotable hammer toward the gate deflector causes the gate to engage the document and bend around the gate deflector to thereby cause the hammer to pivot and urge the document against the wick, thereby applying moisture to those portions of the document.

The foregoing apparatus is especially useful in combination with a buckle chute folder for forming message-containing, self-sealing envelopes. However, because the wick is constantly engaging the adhesive on the envelope, the wick tends to become gummy. Moreover, the wick tends to wear out quickly, thereby necessitating frequent replacement or adjustment. An additional problem arising from the quick wearing out is that the wick soon loses its precise location with respect to the document being wetted and optimal contact between the wick and document is lost. The instant invention therefore provides a wick cartridge assembly which overcomes the foregoing problems and which may be used in a variety of environments, but is especially useful with the moisture applying apparatus described hereinabove.

SUMMARY OF THE INVENTION

The wick cartridge assembly provided by the instant invention comprises a cage having openings at opposite ends thereof, a water permeable, mesh surface secured to the interior of the cage and defining an enclosure at one of the openings, and a length of moistening, wick material having one end thereof abutting the mesh enclosure.

DESCRIPTION OF THE PREFERRED EMBODIMENT

Figure 1:
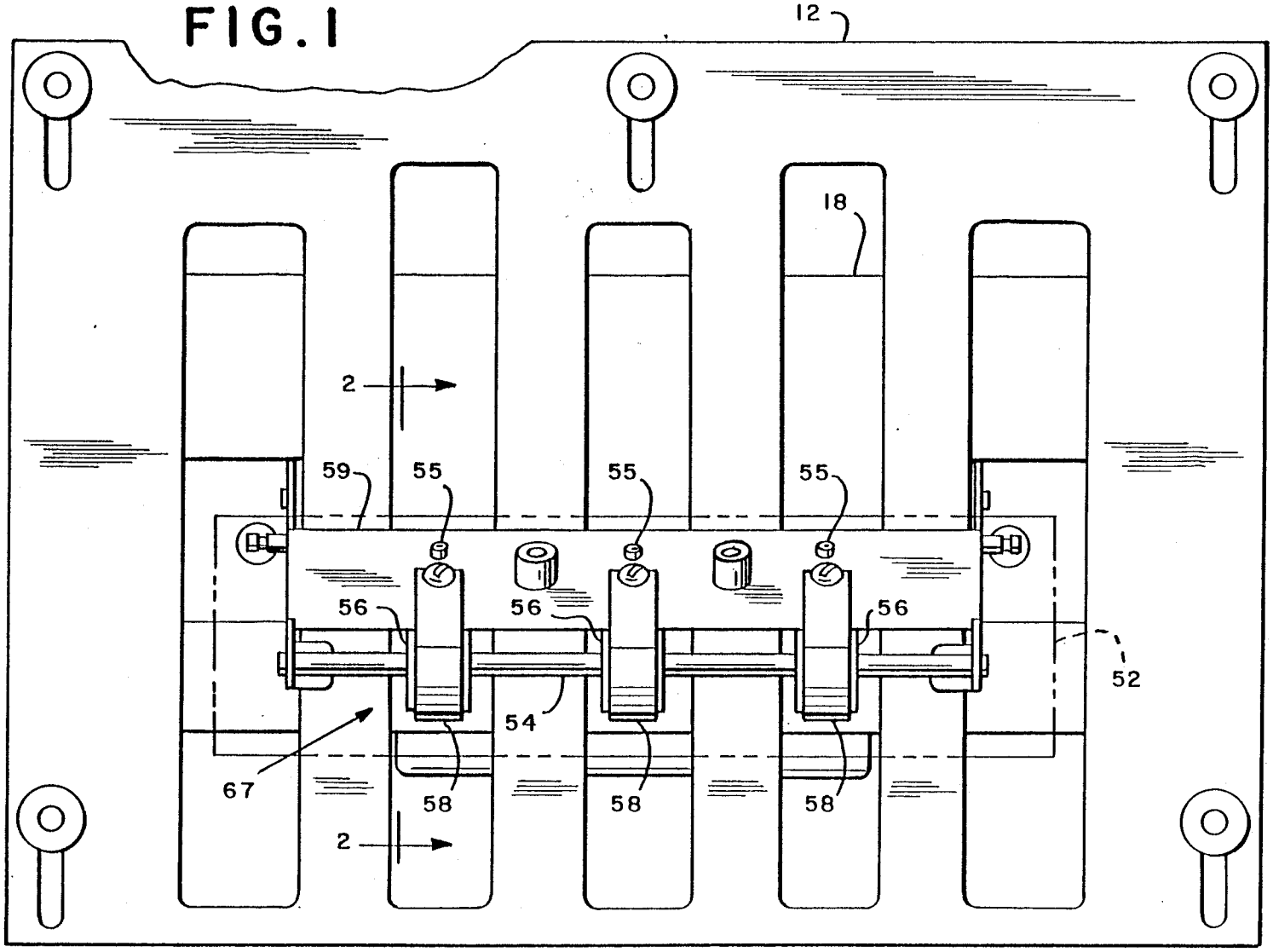
FIG. 1 is a front elevation view of a buckle chute folder having a moistening apparatus employing a wick cartridge assembly in accordance with the instant invention but with the moisture shield removed for clarity.
Figure 2:
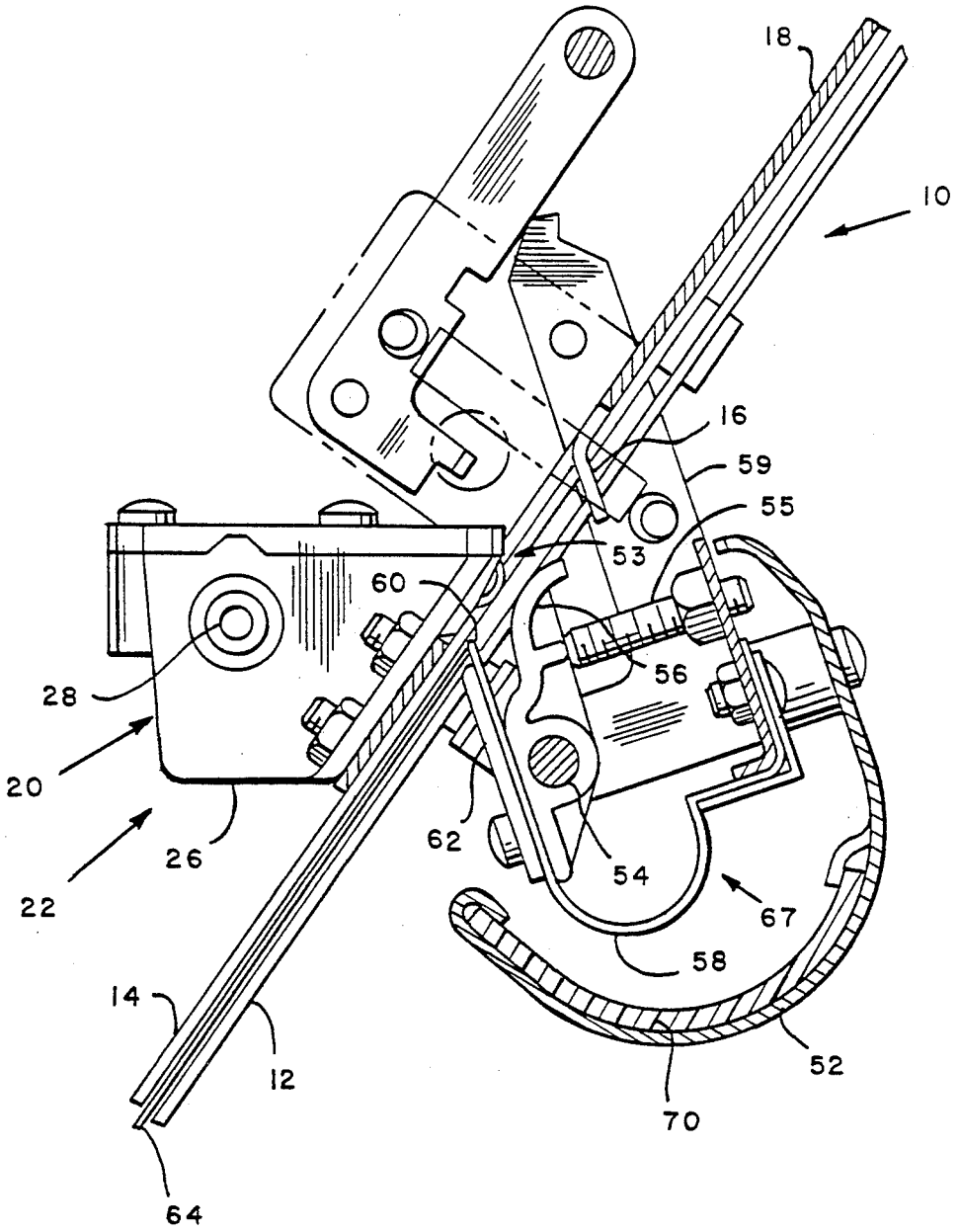
FIG. 2 is a sectional view substantially taken on the plane indicated by the line 2—2 in FIG. 1 but showing the moisture shield omitted in FIG. 1.
Figure 3:
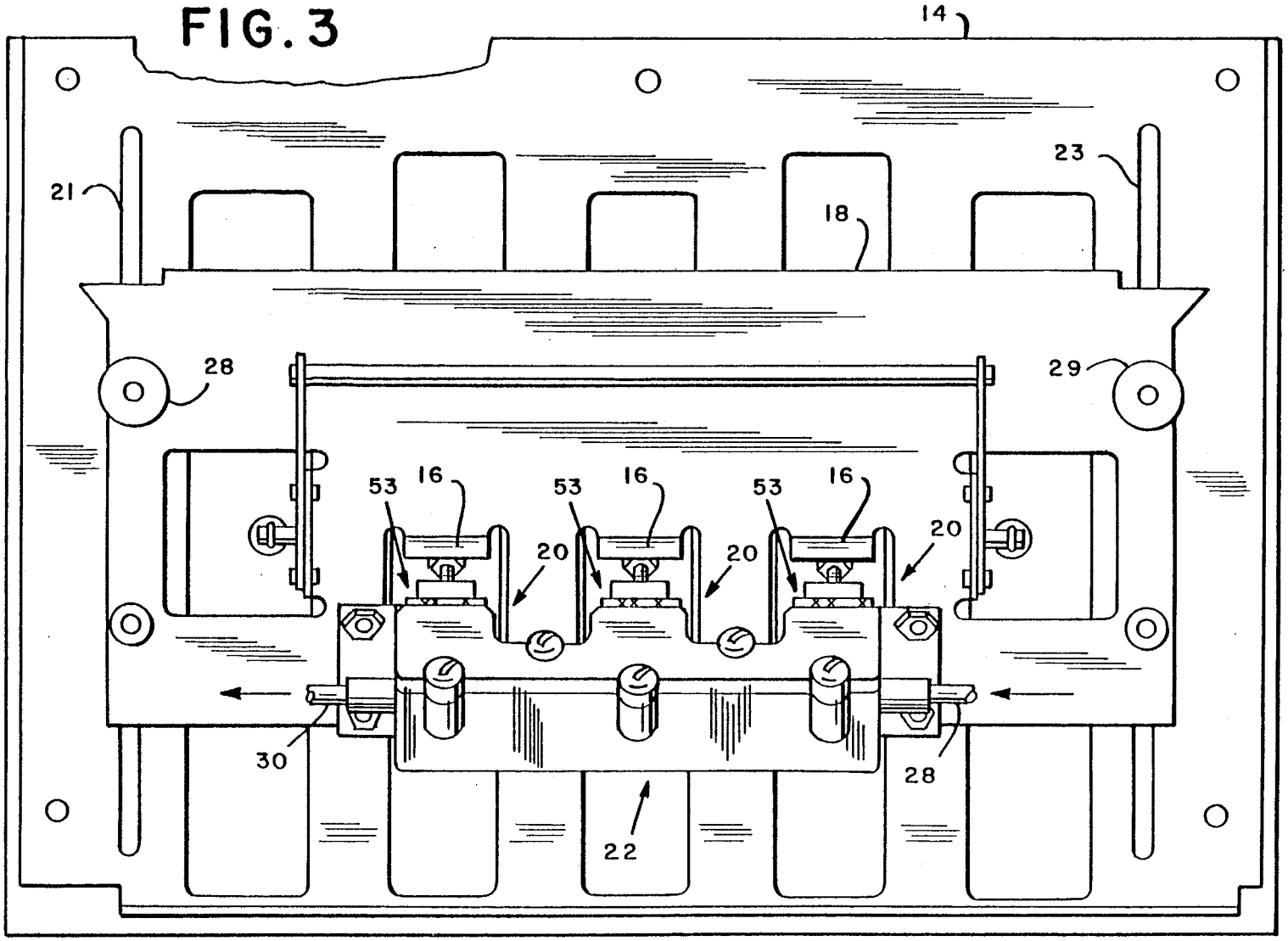
FIG. 3 is a rear elevational view of the apparatus seen in FIG. 1.

In describing the preferred embodiment of the instant invention, reference is made to the drawings, wherein there is seen in FIG. 2 a substantially vertically oriented buckle chute 10 consisting of a pair of opposing plates 12 and 14 with a space therebetween which defines a document path. The buckle chute 10 also includes an adjustable plate 18 (See FIG. 3) slidably mounted in slots 21 and 23 in the plate 14. The adjustable plate 18 also has three stopping bars 16 extending into the document path. The horizontal orientation of the stopping bars 16 can be adjusted by means of bolts 28 and 29 which move the sides of the adjustable plate 18 up or down. The bolts 28 and 29 engage the slots 21 and 23 respectively.

A moistening assembly 22 consisting of three moistening devices 20 is secured to the adjustable plate 18. The moistening assembly 22 includes three reservoirs 26 and an inlet port 28 and an outlet port 30 for water which is pumped into the reservoir 26 by a pump (not shown) from a large container of water. A moistening wick generally designated 53, to be discussed in greater detail hereinafter, extends from the reservoir 26 to the document path between the plates 12 and 14.

Across from the moistening assembly 20 on the other side of the plates 12 and 14 is a hammer/gate assembly generally designated 67 consisting of three pivotable hammers 56 pivotably mounted on a shaft 54 and seating against three set screws 55. The shaft 54 is journalled in a frame 59 which is pivotably connected to the adjustable plate 18. A flexible, one-way gate 58 is secured to the lower portion of each of the hammers 56 for movement therewith. Each gate 58 includes an end portion 60 which extends into the document path. A gate deflector 62 is secured to the gate 58 and hammer 56 for movement therewith.

It is to be understood that the buckle chute 10 has associated with it (but not shown) a series of rollers which feed a document 64 up the buckle chute 10 and continue to feed the document 64 after it has reached the stopping bars 16 into another series of rollers which impart the desired fold to the document 64. Such rollers are conventional and their use with buckle chutes is well known. The moistening assembly 20 is used to apply moisture to a flexible document 64 which contains a water-activated adhesive on some portions thereof. The adhesive portions could be anywhere on the document, and typically in the case of a flexible document to be formed into a sealed envelope, would run along the sides of the document 64 and also comprise three areas on the interior of the document 64 and somewhat near the marginal edge portions. It can be seen in FIG. 3 that the embodiment shown therein is intended to apply moisture to three areas of the document 64 since three moistening wicks 53 are employed. It is possible to use one moistener 20 to wet just one area, or as many as desired for the particular document 64 being folded and sealed into an envelope. It should be understood that the moisture can be applied either to the areas containing the water-activated adhesive or to areas of the document 64 lacking such adhesive but which later are brought into contact with such adhesive-containing areas.

FIG. 2 shows the position of the hammer 56, gate 58 and deflector 62 when the document 64 enters the buckle chute 10. As the document is advanced up the buckle chute 10 by the appropriate feed rollers (not shown) the end 60 of the one-way gate 58 is deflected upward by the document 64. When the document 64 reaches the stopping bars 16, a buckle is created in an interior portion of the document 64 (not shown) as is well known and the document 64 continues to be fed resulting in the document 64 returning down the buckle chute 10. When the document 64 is being fed down the buckle chute 10, the gate portion 60 is engaged by the document 64 and bends around the gate deflector 62, which causes the hammer 56 to be pivoted counterclockwise and urges the document 64 firmly against the wick 53. Continued withdrawal of the document 64 from the buckle chute 10 wraps the gate 58 around the deflector 62 thereby developing even greater friction which in turn creates maximum force from the hammer 56 against the wick 53 and optimum water transfer from the wick 53 to the document 64.

Also attached to the pivotable frame 59 is a shroud 52 having a moisture absorbency lining 70 for absorbing any water which may leak from the adjacent apparatus.

Figure 6:
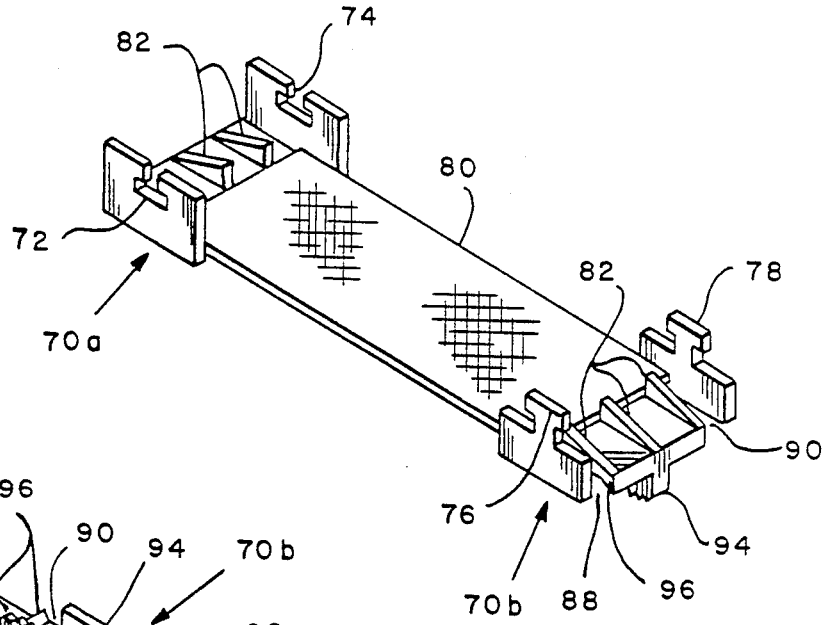
FIG. 6 is a perspective view of the wick cartridge assembly prior to its being assembled into operational form.
Figure 5:
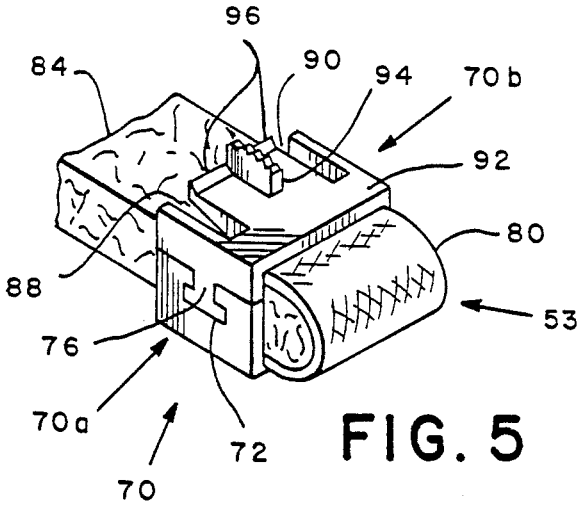
FIG. 5 is a perspective view of the wick cartridge assembly employed in the moistening apparatus seen in Fig. 4.
Figure 4:
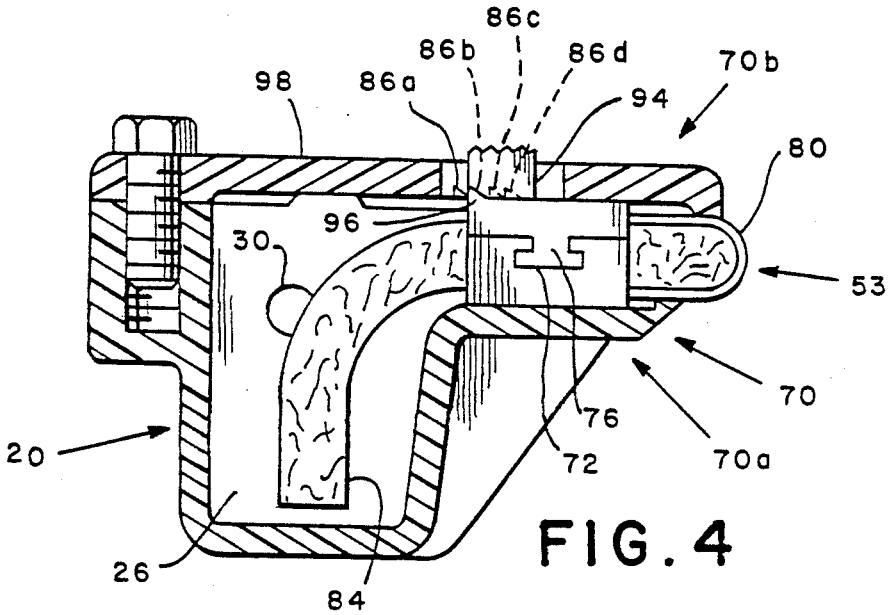
FIG. 4 is a central, vertical sectional view of the moistening apparatus seen in FIG. 1.

The moistening wick cartridge assembly 53 is shown in assembled form in FIG. 5. The assembly 53 includes a cage 70 having mating parts 70*a* and 70*b* as best seen in FIG. 6. Cage part 70*a* includes a pair of grooves 72 and 74 while cage part 70*b* includes a pair of tongues 76 and 78 which fit into the grooves 72 and 74 respectively. Extending between the cage parts 70*a* and 70*b* is a 0.005 inch thick, water permeable wear surface 80, preferably nylon filament mesh, sonically welded in place to the interior portions of the cage parts 70*a* and 70*b*. It is important that the fibers in the mesh surface 80 run diagonally to the direction of the flow of the document 64 that will pass over the wick assembly 53, as indicated by the diagonal lines in FIGS. 5 and 6, in order to minimize the chances of the mesh surface 80 catching the edges of the document 64. It is also preferable that the edges of the mesh surface 80 be ultrasonically welded to reduce the likelihood of the fibers unraveling. The interior portions of the cage parts 70*a* and 70*b* also include a plurality of angled ribs 82 which function to prevent the wicking material 84 from retracting from the cage 70. The top of the reservoir 26 includes a series of detents 86*a–d*. The top surface 92 of the cage part 70*b* includes a pair of channels 88 and 90. One end of the surface 92 includes a welt 96; because of the channels 88 and 90, the welt 96 on the top surface 92 is pivotable and a depressible flange 94 can be depressed by an operator of the buckle chute 10 to cause the welt 96 to be lowered beneath the top surface 98 of the reservoir 26 and to catch on any of the detents 86*a–d* as desired by the operator of the buckle chute 10 in order to accurately locate the wick 80 with respect to the document 64 passing thereover.

Once the mesh surface 80 is welded to the cage parts 70*a* and 70*b*, the desired length of wicking material 84, preferably substantially rectangular in cross section, is inserted between an upper and lower fold of mesh 80 and the cage parts 70*a* and 70*b* are mated by inserting the tongue portions 76 and 78 into the groove portions 72 and 74 respectively. Once assembled into the unit seen in FIG. 5, the wick assembly 53 is ready for insertion into the reservoir 26 and functions in accordance with the parameters set forth hereinabove.

It can be seen that the wick cartridge assembly 53 allows for positive location of the wick 84 with respect to the document 64 to be wetted, and that by covering the face of the wick 84 with a water permeable, nylon mesh, there is created a self-cleaning, wear resistant surface that will last a long time with minimal wear, thereby assuring optimal location of the wick 84 with respect to the document 64 to be wetted for a long period of time.

It should be noted that the wick cartridge assembly 53 can be used in environments other than a buckle chute; particularly, it would be especially useful in a mailing machine as a replacement for the standard wicking assemblies used therein.

It should be understood by those skilled in the art that various modifications may be made in the present invention without departing from the spirit and scope thereof, as described in the specification and defined in the appended claims.

What is claimed is:

1. A wick cartridge assembly, comprising:

a cage having openings at opposite ends thereof;

a water permeable, mesh surface secured to the interior of said cage and defining an enclosure at one of said openings; and a length of moistening, wick material having one end thereof abutting said mesh enclosure.

2. The assembly of claim 1, wherein the mesh surface includes fibers, said fibers being oriented diagonally with respect to said cage openings.

3. The assembly of claim 2, wherein the edges of said mesh surface are ultrasonically welded.

4. The assembly of claim 3, wherein said mesh surface is ultrasonically welded to said cage.

5. The assembly of claim 4, wherein the interior portion of said cage includes a plurality of angled ribs for preventing the wick material from retracting from the cage.

6. A moistening apparatus, comprising:

a reservoir for water;

a cage having openings at opposite ends thereof removably secured to said reservoir;

a water permeable, mesh surface secured to the interior of said cage and defining an enclosure at one of said openings; and a length of moistening, wick material having one end thereof abutting said mesh enclosure and the other end thereof extending into said reservoir.

7. The apparatus of claim 6, wherein the mesh surface includes fibers, said fibers being oriented diagonally with respect to said cage openings.

8. The apparatus of claim 7, wherein the edges of said mesh surface are ultrasonically welded.

9. The apparatus of claim 8, wherein said mesh surface is ultrasonically welded to said cage.

10. The apparatus of claim 9, wherein the interior portion of said cage includes a plurality of angled ribs for preventing the wick material from retracting from the cage.

11. Apparatus for applying moisture to a flexible document containing a water-activated adhesive, comprising:

A. a buckle chute having i. a pair of opposing plates defining a document path therebetween, ii. a stopping bar situated between said opposing plates, and iii. an adjustable plate slidably mounted on one of said opposing plates; and B. a moistening device fixedly secured to said adjustable plate, said moistening device including i. a reservoir for storing a source of water secured to said adjustable plate and situated adjacent one of said buckle chute plates on one side of said document path, ii. a wick cartridge assembly having a cage with openings at opposite ends thereof removably secured to said reservoir, a water permeable, mesh surface secured to the interior of said cage and defining an enclosure at one of said openings, and a length of moistening, wick material having one end thereof abutting said mesh enclosure and the other end thereof extending into said reservoir.

iii. a pivotable hammer pivotably mounted to said adjustable plate on the other side of said document path and extending toward the end of the wick material extending to said document path, iv. a flexible, one-way gate secured to the lower portion of said hammer for movement therewith, said gate having an end portion extending into said document path, and v. a gate deflector secured to said gate and lower hammer portion for movement therewith, wherein movement of a document up the buckle chute toward the stopping bar causes said gate to flex out of the document path and movement of a document down said buckle chute away from said stopping bar causes said gate to engage said document and bend around said gate deflector to thereby cause said hammer to pivot and urge said document against said wick material, whereby moisture is applied to those portions of said document urged against said wick.

12. The apparatus of claim 11, wherein the mesh surface includes fibers, said fibers being oriented diagonally with respect to said cage openings.

13. The apparatus of claim 12, wherein the edges of said mesh surface are ultrasonically welded.

14. The apparatus of claim 13, wherein said mesh surface is ultrasonically welded to said cage.

15. The apparatus of claim 14, wherein the interior portion of said cage includes a plurality of angled ribs for preventing the wick material from retracting from the cage.

* * * * *